US011597567B2

(12) United States Patent
French et al.

(10) Patent No.: US 11,597,567 B2
(45) Date of Patent: Mar. 7, 2023

(54) PACKAGE

(71) Applicant: Berry Global, Inc., Evansville, IN (US)

(72) Inventors: Jordan Robert French, Evansville, IN (US); Seth Tempel, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 46 days.

(21) Appl. No.: 17/382,595

(22) Filed: Jul. 22, 2021

(65) Prior Publication Data

US 2021/0347538 A1 Nov. 11, 2021

Related U.S. Application Data

(63) Continuation-in-part of application No. 16/295,186, filed on Mar. 7, 2019, now abandoned.

(60) Provisional application No. 62/639,549, filed on Mar. 7, 2018.

(51) Int. Cl.

| | |
|---|---|
| ***B65D 77/04*** | (2006.01) |
| ***B65D 50/04*** | (2006.01) |
| ***B65D 1/36*** | (2006.01) |
| ***B65D 51/20*** | (2006.01) |

(52) U.S. Cl.

CPC ..... *B65D 50/045* (2013.01); *B65D 1/36* (2013.01); *B65D 51/20* (2013.01); *B65D 2251/0018* (2013.01); *B65D 2251/0093* (2013.01)

(58) Field of Classification Search

CPC .... B65D 50/046; B65D 50/045; B65D 50/04; B65D 50/066; B65D 77/046; B65D 77/0453; B65D 77/0446; B65D 43/0204; B65D 2251/0018; B65D 2251/0093; B65D 51/20; B65D 1/36

See application file for complete search history.

(56) References Cited

U.S. PATENT DOCUMENTS 1,163,773 A * 12/1915 Ross ..... B65D 50/045 70/289

2010/0133140 A1* 6/2010 Bailey ..... B65D 9/08 220/780

* cited by examiner

*Primary Examiner* — Stephen J Castellano

(57) ABSTRACT

A package with a selectively openable case and tray to selectively allow access to one or more compartments is disclosed.

20 Claims, 13 Drawing Sheets

PACKAGE

PRIORITY CLAIM

This application is a continuation-in-part of U.S. application Ser. No. 16/295,186, filed Mar. 7, 2019, now abandoned, which claims priority under 35 U.S.C. § 119(e) to U.S. Provisional Application Ser. No. 62/639,549, filed Mar. 7, 2018, each of which is expressly incorporated by reference herein.

TECHNICAL FIELD

The present disclosure relates generally to a child resistant package, and more specifically to a package including a case and a tray that is movable relative to the case between an open position and a closed position and that is also movable between a locked position and an unlocked position.

BACKGROUND

It is often desirable to provide a container for storing items, which may include perishable items, that also has features that make opening it child resistant.

SUMMARY

Certain embodiments according to the present disclosure provide a package with a tray that is selectively openable and closeable with a case, and wherein the tray and case may provide an unlocked position and a locked position.

In one aspect, for instance, a child resistant package is provided having a case and a tray. The tray is selectively insertable into the case to provide a closed position and removable from the case to provide an open position. The tray has at least one product storage compartment, a first end, and a second end located opposite the first end. The product storage compartment is disposed between the first end and the second end. A pocket is adjacent the second end of the tray. The case has a first end with an opening configured to allow insertion and removal of the tray within the case, and the case has a second end opposite the case first end. The case second end includes a slot for receiving the second end of the tray. A locking protrusion on the case is configured to engage the pocket of the tray. The tray second end is movable by a user input between a locked position and an unlocked position. The locking protrusion of the case and the pocket of the tray cooperate to form a mechanical stop inhibiting moving the tray relative to the case from the closed position to the open position when the tray is in the locked position. The tray is movable in an axial direction between the open position and the closed position. The tray second end is movable from the locked position to the unlocked position by a user input causing movement of the pocket relative to the locking protrusion in a direction transverse to the axial direction to remove the mechanical stop and allow removal of the tray from the case.

In another aspect, for instance, a child resistant package is provided having a case and a tray. The tray is selectively insertable into the case to provide a closed position and removable from the case to provide an open position. The tray has at least one product storage compartment, a first end, and a second end located opposite the first end, wherein the product storage compartment is disposed between the first end and the second end. The case has a first end with an opening configured to allow insertion and removal of the tray within the case, and the case has a second end opposite the case first end. The second end of the tray is configured to cooperate with the case to form a locked position. The tray second end is movable by a user input between the locked position and an unlocked position. The tray is movable in an axial direction relative to the case between the open position and the closed position. A mechanical stop prevents the tray from moving from the closed position to the open position when the tray is in the locked position. The tray is movable to the unlocked position to remove the mechanical stop and allow movement of the tray from the closed position to the open position. An interior support surface is located in the case and configured to prevent downward motion of a portion of the tray when the tray is moved from the locked position to the unlocked position. The interior support surface biases the portion of the tray toward the locked position in the absence of the user input moving the tray from the locked position to the unlocked position.

In yet another aspect, for instance, a child resistant package is provided having a case and a tray. The tray is selectively insertable into the case to provide a closed position and removable from the case to provide an open position. The tray has at least one product storage compartment, a first end, and a second end located opposite the first end. The product storage compartment is disposed between the first end and the second end. A pocket is adjacent the second end of the tray. The case has a first end with an opening configured to allow insertion and removal of the tray within the case, and the case has a second end opposite the case first end, wherein the case second end includes a slot for receiving the second end of the tray. A locking protrusion on the case is configured to engage the pocket of the tray. The tray second end is movable by a user input between a locked position and an unlocked position. The locking protrusion of the case and the pocket of the tray cooperate to form a mechanical stop inhibiting moving the tray relative to the case from the closed position to the open position when the tray is in the locked position. The tray is movable in an axial direction between the open position and the closed position. The tray second end is movable from the locked position to the unlocked position by a user input causing movement of the pocket relative to the locking protrusion in a direction transverse to the axial direction to remove the mechanical stop and allow removal of the tray from the case. An interior support surface is located in the case and configured to prevent downward motion of a portion of the tray when the tray is moved from the locked position to the unlocked position. The interior support surface biases the portion of the tray toward the locked position in the absence of the user input moving the tray from the locked position to the unlocked position.

BRIEF DESCRIPTION OF THE DRAWINGS

Embodiments now will be described more fully hereinafter with reference to the accompanying drawings, in which some, but not all embodiments may be shown. Indeed, embodiments may be illustrated or described in many different forms and the present disclosure should not be construed as limited to the embodiments set forth herein. Like numbers refer to like elements throughout, and wherein.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
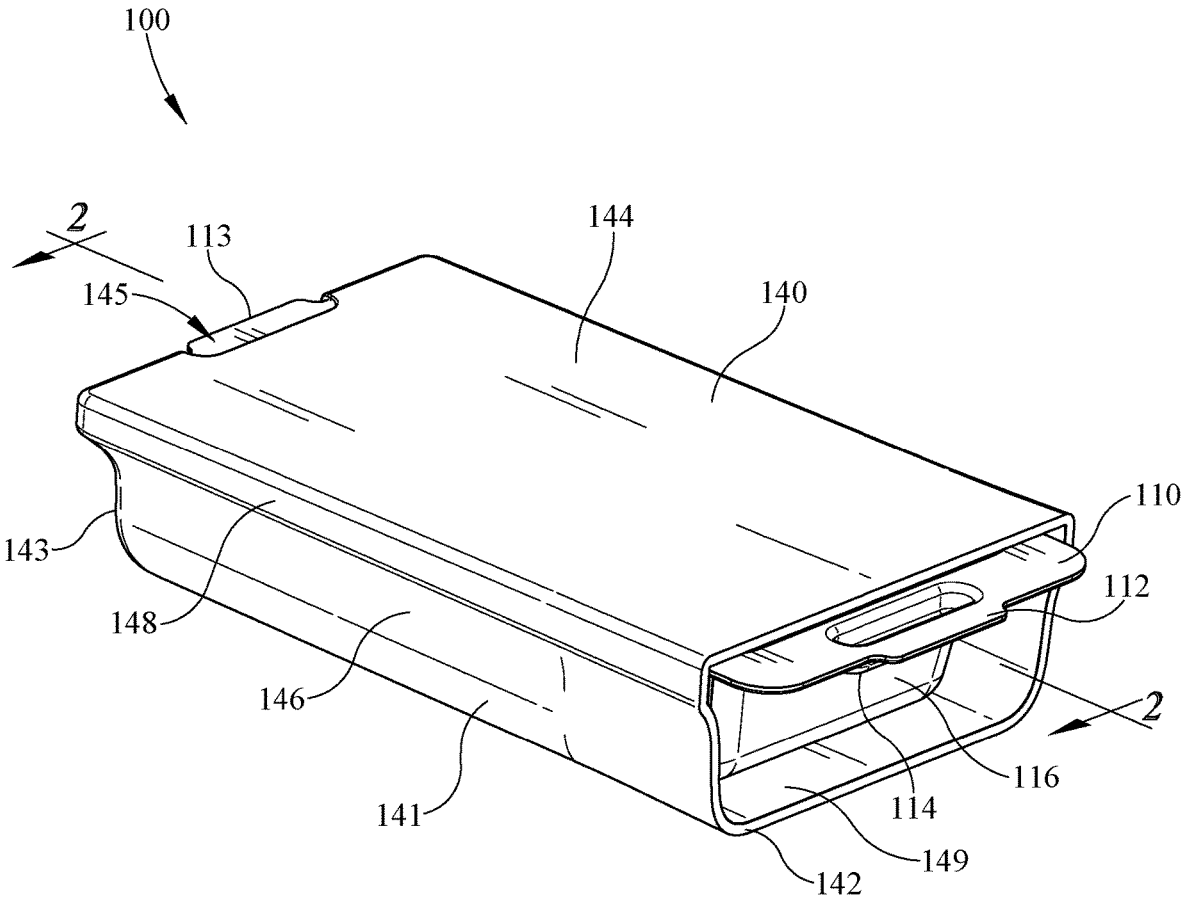
FIG. 1 illustrates a front perspective view of an embodiment of a package in a closed and locked position.

Some embodiments of a package 100 may include a tray 110 and/or a case 140, such as shown in FIG. 1, with package 100 in a closed position. Tray 110 may include one or more storage compartments 111, which may be configured to hold products or contents, and compartment 111 may be covered by case 140 when in the closed position such that contents of compartment 111 are inaccessible. Tray 110 may extend from a first end having a first push tab 112 to a second end having a second push tab 113. The first end may include a first pocket 114 adjacent first push tab 112 and/or the second end may include a second pocket 115 adjacent second push tab 113 (see, e.g., FIG. 2 for an illustration of second pocket 115). A user may grip tray 110 at the first end and/or at first push tab 112 and/or first pocket 114 to move tray 110 relative to case 140 from the closed position to an open position and/or a partially open position in which tray 110, compartment 111, and/or contents of compartment 111 are at least partially accessible to a user (as discussed more below, package 100 may include a cover 160 such as a film covering over compartment 111, with cover 160 accessible when package 100 is in the open position or a partially open position). Tray 110 may move axially and/or transversely relative to case 140 when moving between the open position and the closed position, such as by sliding within and/or relative to case 140.

As shown in FIG. 1, case 140 may have a side wall 141 defining an interior region therein into which tray 110 may slide, enter, and/or be retained. In some embodiments, case 140 may have a first end 142 that may be substantially open to allow tray 110 to enter or exit therefrom. Case 140 may have a second end 143 oppositely disposed first end 142. Second end 143 may be substantially closed, as shown for example in FIG. 3, and/or configured such that tray 110 is prevented or blocked from moving past second end 143. Case 140 may extend from first end 142 to second end 143, for example, along a top wall 144, a bottom wall 149, a first side wall 146, and/or a second side wall 147. Top wall 144 may be oppositely disposed bottom wall 149 with first side wall 146 and second side wall 147 extending from top wall 144 to bottom wall 149. First side wall 146 may be oppositely disposed second side wall 147, with top wall 144 and/or bottom wall 149 disposed therebetween. Case side wall 141 may include any or all of first side wall 146, second side wall 147, top wall 144, and bottom wall 149.

Figure 5:
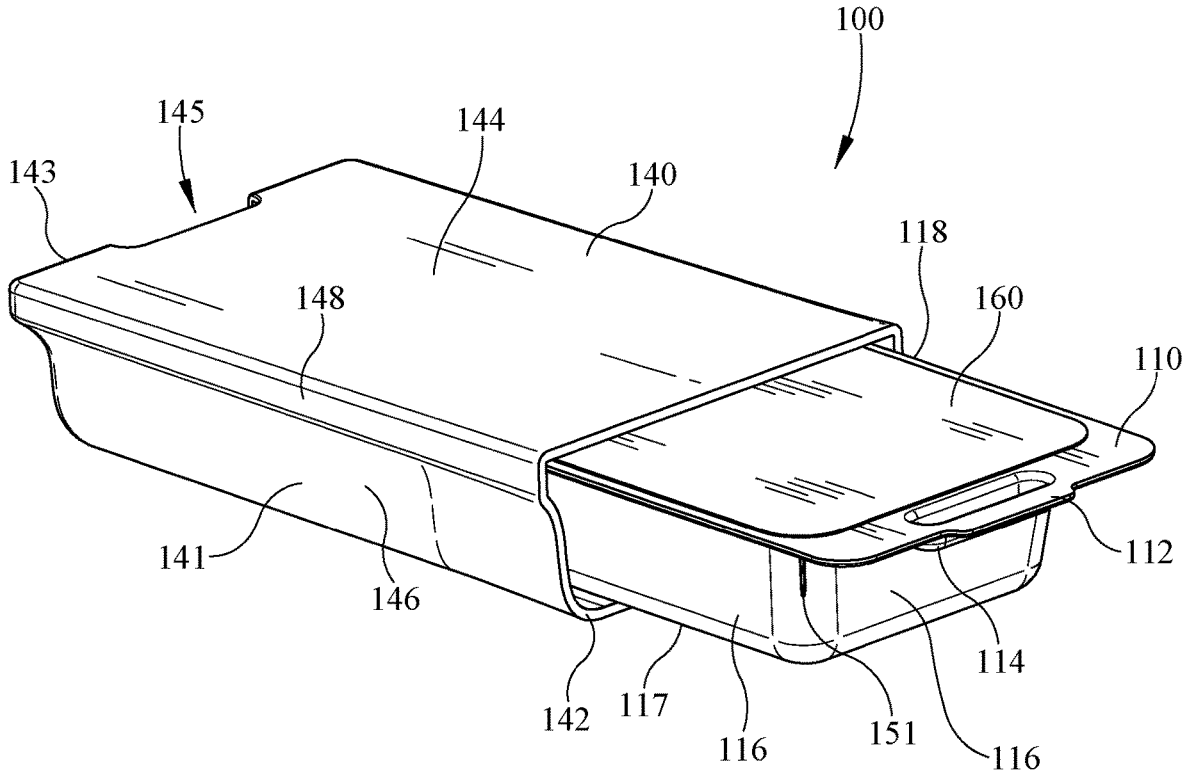
FIG. 5 illustrates a front perspective view of the package of FIG. 1 now in a partially open position.

Case 140 may include a shoulder 148, which may be wider than adjacent areas of first side wall 146, second side wall 147, and/or second end 143, as shown for example in FIG. 5. Shoulder 148 may accommodate, for example, a relatively wider area of tray 110 such as a flange 118 disposed at the top of tray 110 opposite a bottom or floor 117 of tray compartment 111. Flange 118 may be located around an outer perimeter of tray 110 and/or around a top opening into compartment 111. Flange 118 may extend outwardly to provide a shelf or ledge that a user may grip, that may cooperate with shoulder 148 and/or an interior rib 180 either or both which may hold flange 118 or tray 110, or for any other reason or combination of reasons. A slot 145 may be provided in case 140, for example at or near second end 143 and/or top wall 144 to allow tray second end 113 extend outwardly through slot 145 and/or to allow a user to access second end 113. A user may for example actuate second end 113 to move tray 113 from a locked position to an unlocked position such that the user may slide tray 110 from the closed position to the open position as discussed in more detail below.

Figure 2:
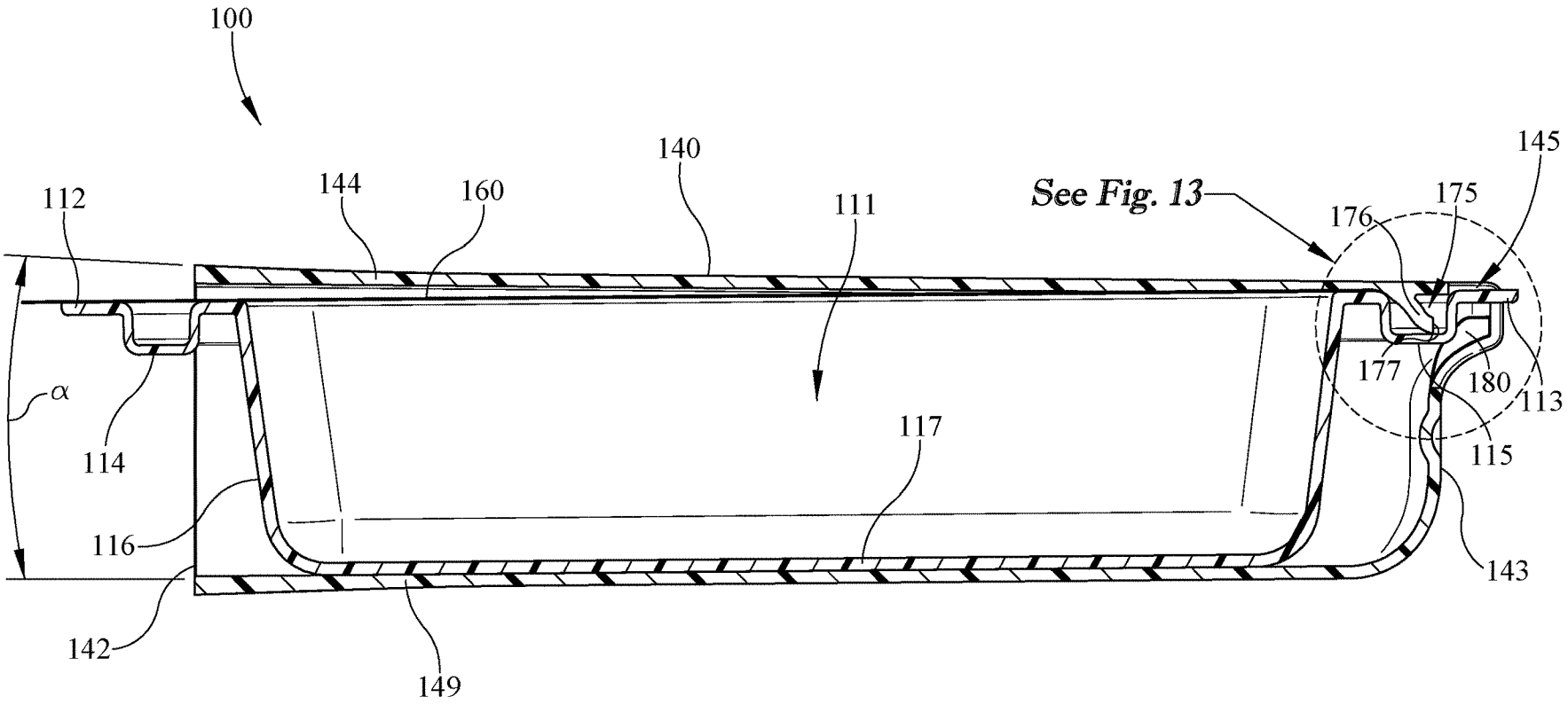
FIG. 2 illustrates a cross-section view of the package of FIG. 1.

Case 140 may include a locking feature such as locking protrusion 175, which may cooperate with a feature of tray 110, such as second pocket 115, to lock tray 110 into the closed position when in a locked position as shown for example in FIG. 2. Locking protrusion 175 may extend downwardly from top wall 144 of case 140 along a protrusion body 176 to a protrusion tip 177. Locking protrusion 175 may be configured to form a mechanical stop with pocket 115 when in the locked position, for example, when locking protrusion tip 177 abuts an outward side wall 115*b* of pocket 115 as shown in more detail in FIG. 4. First pocket 114 and second pocket 115 may be oppositely disposed on the first end and the second end of tray 110 but substantially similar in shape such that either pocket 114, 115 may engage locking protrusion 175. In this way, for example, tray 110 may be configured such that it is reversible with respect to case 140 and/or such that it can be inserted into case 140 with either end or push tab 112, 113 entering first and in both configurations capable of forming the closed and locked position illustrated in FIG. 2. Locking protrusion 175 may form a mechanical stop with either first pocket 114 or second pocket 115, depending on whether the first end or the second end of tray 110 is inserted first into case 140. Case 140 may be formed with an angle α measured with respect to top wall 144 and bottom wall 149 such that the opening at first end 142 is larger than tray 110. First side wall 146 may be disposed at an angle β (not shown) relative to second side wall 147 instead of or in addition to the angle of top wall 144 relative to bottom wall 149. Either or both of angle α and angle β may be greater than zero, for example it may be about 1 degree, to facilitate easier insertion of tray 110 into case 140 and/or for any other reason. Angle α and/or angle β may be in the range of about 0.2 degrees to about 20 degrees, in the range of about 0.2 degrees to about 10 degrees, in the range of about 0.2 degrees to about 4 degrees, in the range of about 0.4 degrees to about 4 degrees, in the range of about 0.8 degrees to about 4 degrees, in the range of about 0.8 degrees to about 2 degrees, and/or in the range of about 0.8 degrees to about 1.2 degrees.

Figure 3:
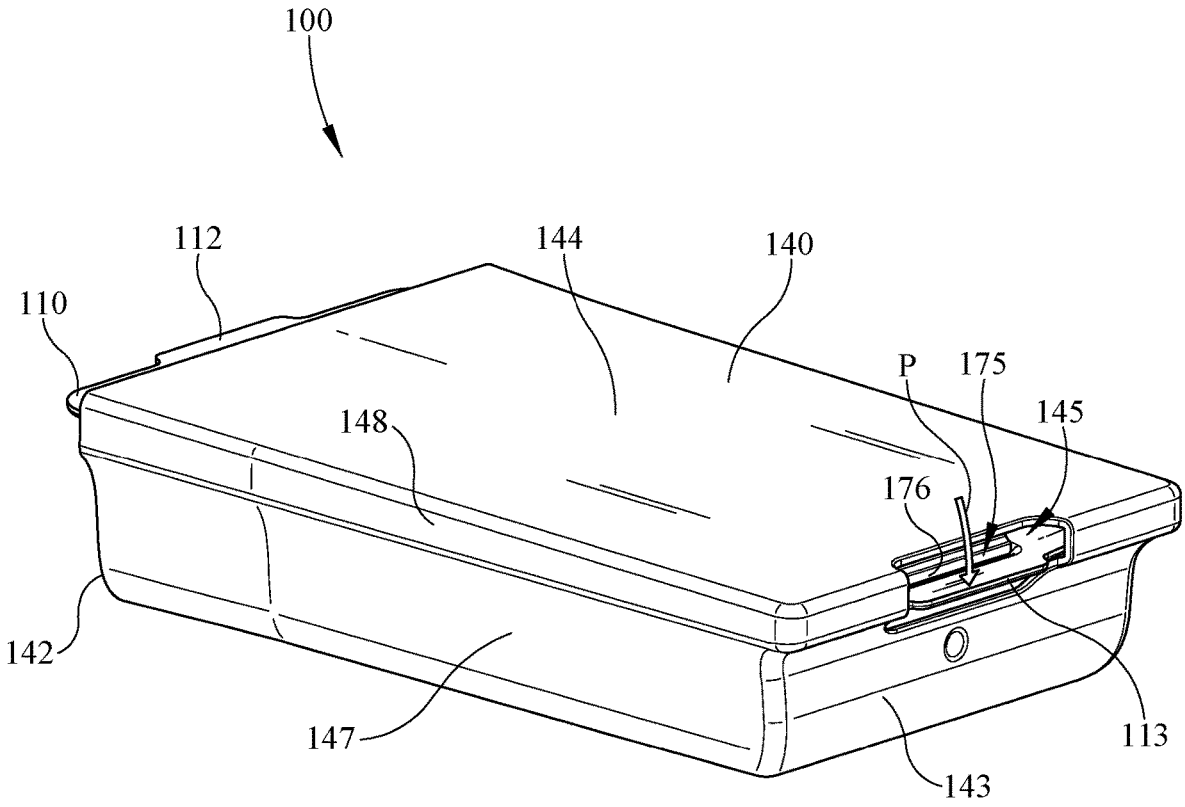
FIG. 3 illustrates a rear perspective view of the package of FIG. 1 in a closed and unlocked position.
Figure 4:
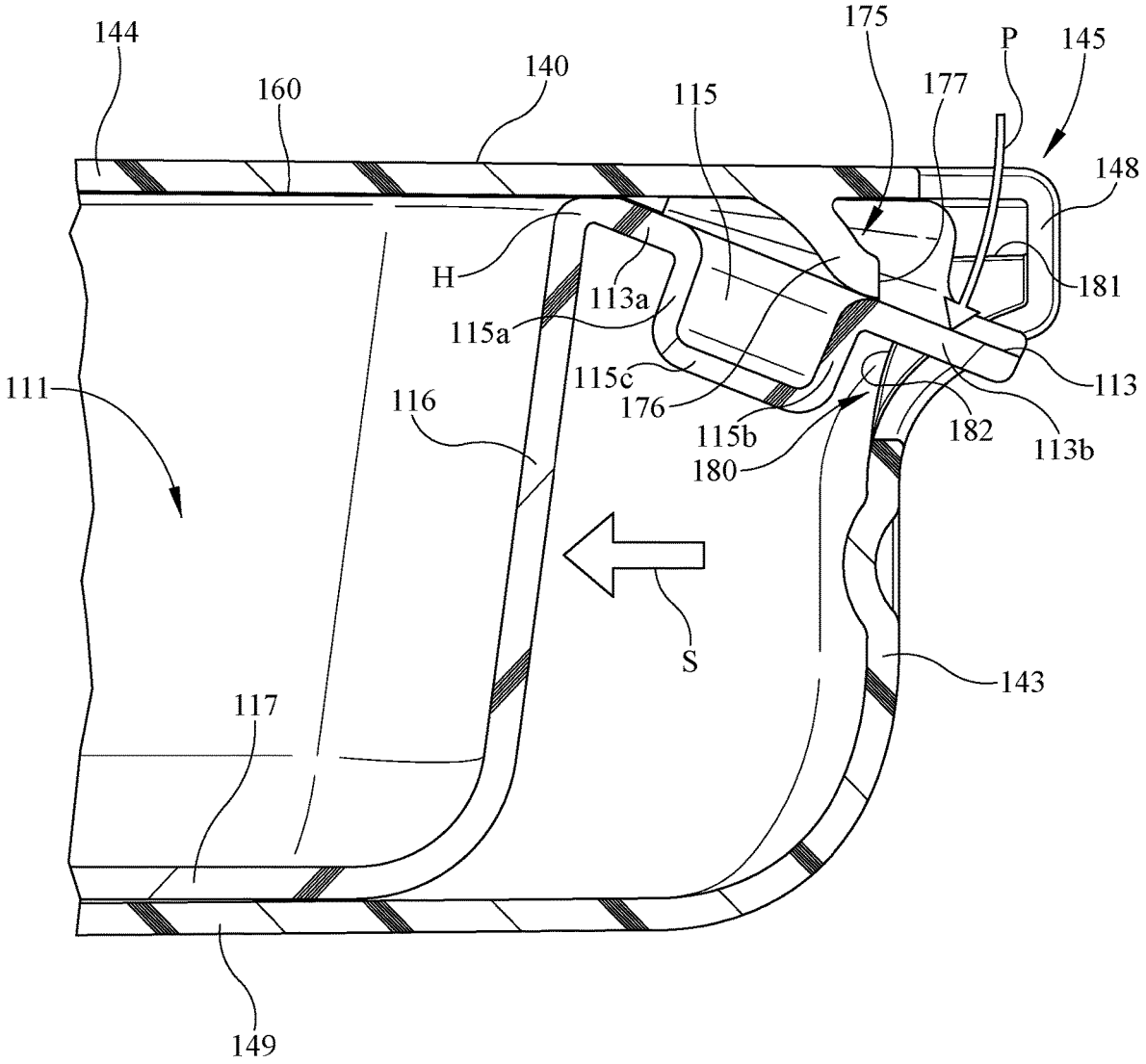
FIG. 4 illustrates a cross-section view of a portion of the package of FIG. 3 in an unlocked position as it is moving away from the closed position.

A user may actuate tray 110 to move it from the locked position to an unlocked position, for example, by providing an input at or near the second end of tray 110, for example, at or near second push tab 113 with a downward push P as shown in FIGS. 3 and 4. Pushing second push tab 113 down may cause pocket 115 to move downwardly relative to unlocking protrusion 175 such that pocket 115 disengages locking protrusion 175 and allows transverse or axial motion of tray 110 relative to case 140. For example, tray 110 may slide relative to case 140 in the axial or longitudinal direction when in the unlocked position as shown for example by a motion or slide S in FIG. 4. Tray 110 may include a side wall 116, which may form at least a portion of compartment 111, and which may extend upwardly from a tray floor 117 in a direction toward flange 118 and/or case top wall 144 when in the closed position.

As shown in FIG. 4, tray 110 and/or flange 118 may include a first outwardly extending portion 113*a* extending away from tray side wall 116 toward pocket 115. Pocket 115 may include an inwardly disposed side wall 115*a*, a pocket floor 115*c*, and/or an outwardly disposed side wall 115*b*. In some embodiments, pocket 115 may not include pocket floor 115*c* and/or inwardly disposed side wall 115*a*, for example. Tray 110 may include a second outwardly extending portion 113*b* at or near second end 113. Pocket 115 may be disposed between first outwardly extending portion 113*a* and second outwardly extending portion 113*b*. When in a locked position, locking protrusion 175 and/or locking protrusion tip 177 may be aligned in an axial direction with outwardly disposed side wall 115*b* of pocket 115 to form a mechanical stop that may prevent or inhibit axial or transverse motion of tray 110 relative to case 140, as indicated for example by slide motion S. Slide motion S may move tray 110 from the closed position to the open position or a partially open position. In the locked position, tray 110 may be prevented or inhibited from slide motion S relative to case 140. In the unlocked position, slide motion S of tray 110 relative to case 140 may be allowed. When tray 110 and/or tray second end 113 is actuated, for example, by a downward user input or push P at or near second end 113 and/or second pocket 115, second end 113 and/or second pocket 115 may move or rotate downwardly relative to case 140 and/or locking protrusion 175, for example, by rotating about a hinge H. Hinge H may be disposed at an intersection of tray side wall 116 and first outwardly extending portion 113*a*. Second end 113 and/or second pocket 115 may move between the locked position and the unlocked position by rotating upwardly and downwardly, respectively, with respect to side wall 116 and/or about hinge H, and/or to bring outwardly disposed side wall 115*b* and locking protrusion tip 177 into and out of axial or longitudinal alignment.

Figure 6:
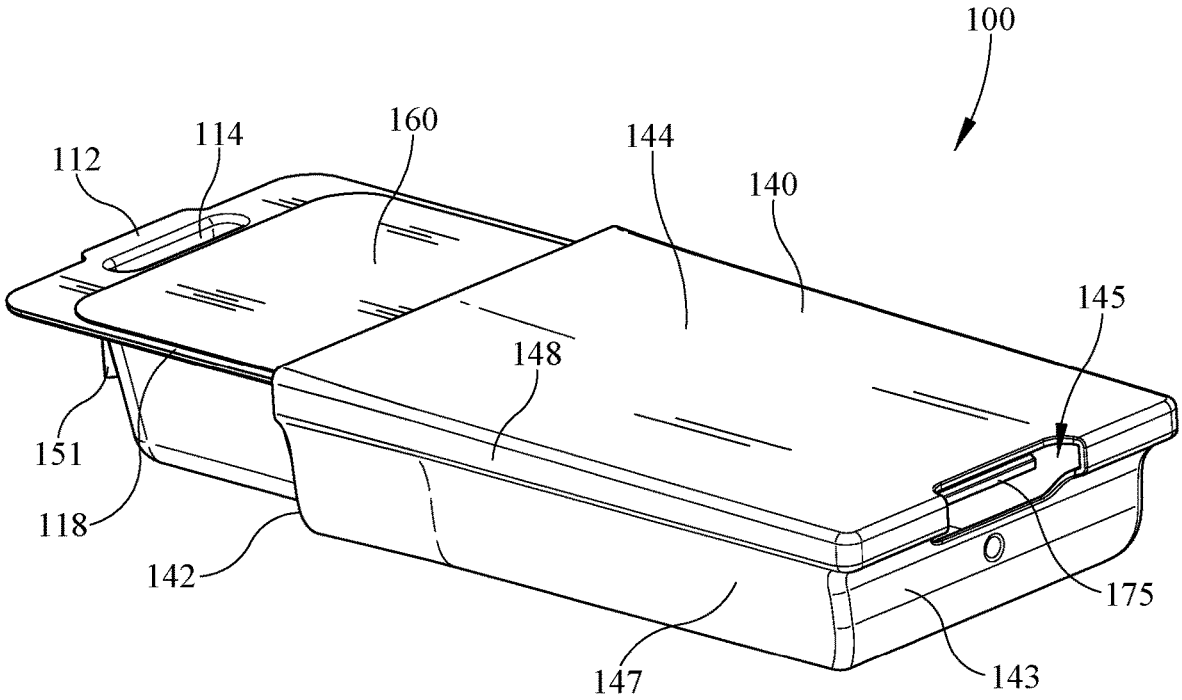
FIG. 6 illustrates a rear perspective view of the package of FIG. 5 in a partially open position.

Package 100 is shown in a partially open position in FIGS. 5 and 6, with tray 110 slid and/or pulled somewhat out of case 140. Tray 110 may include one or more compartments 111 within which items, products, contents, etc. may be stored or retained. For example, any or all of compartments 111 may be configured to contain edible, medicinal, and/or perishable contents within. Package 100 may include a cover 160 over compartment 111 that may facilitate protection, insulation, and/or preservation of freshness of the contents of package 100, tray 110, and/or compartment 111, for example, as discussed more below. Tray 110 may include one or more structural support members such as corner ribs 151 for any of a variety of reasons, including but not limited to adding structural rigidity to tray 110 and/or flange 118, and/or to facilitate stacking or nesting of multiple trays together.

Figure 7:
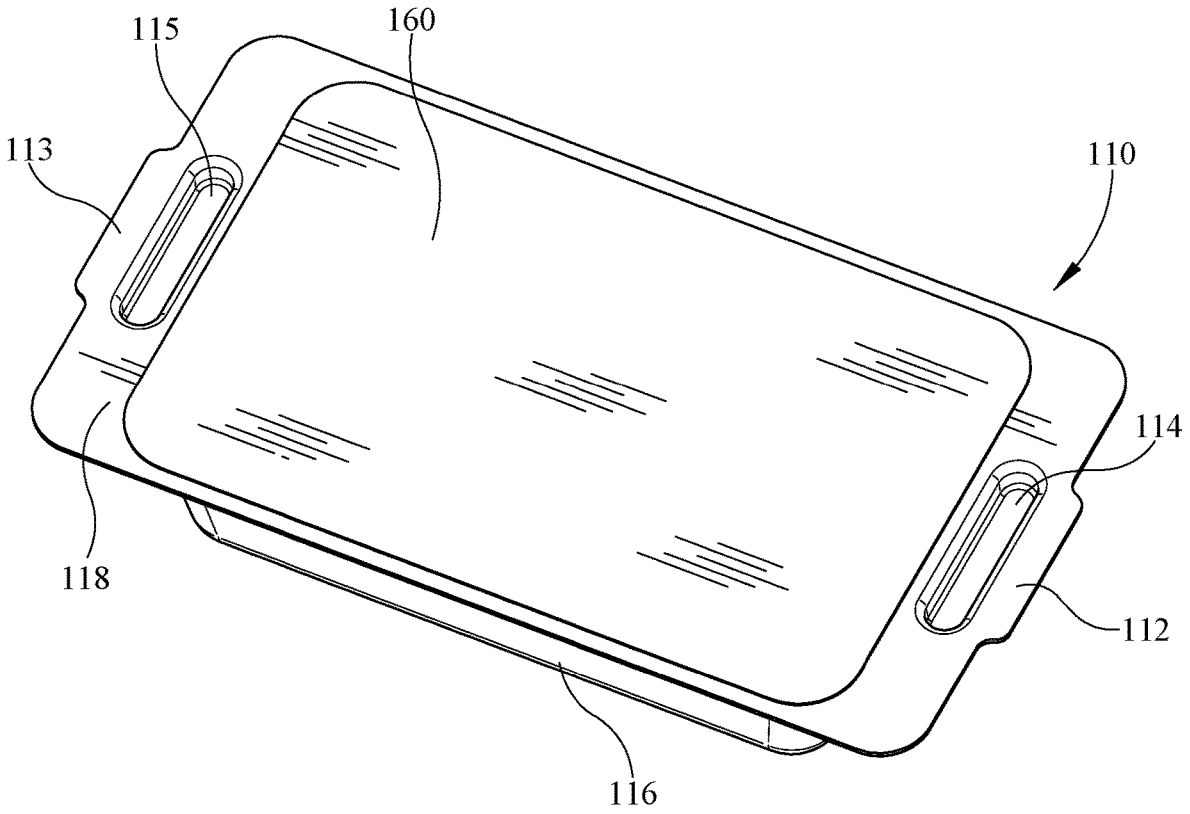
FIG. 7 illustrates an embodiment of a tray and a cover that may be used as part of the package of FIG. 1.
Figure 8:
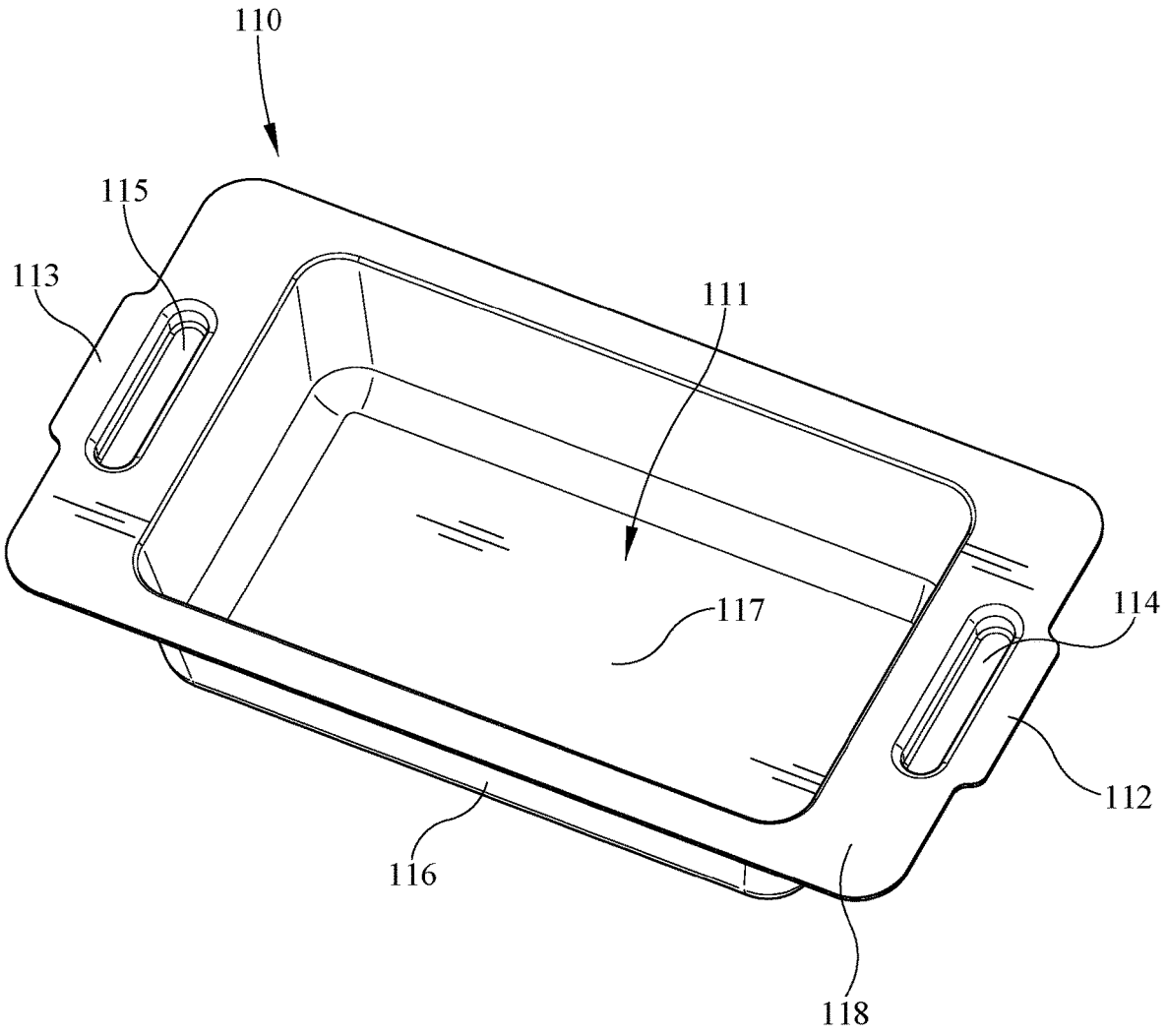
FIG. 8 illustrates a perspective view of the tray of FIG. 7 with the cover removed to uncover a storage compartment of the tray.

FIGS. 7 and 8 illustrate tray 110 in an open position relative to case 140, in which tray 110 is completely removed from case 140. FIG. 7 illustrates tray 110 with cover 160 on and covering compartment 111. FIG. 8 illustrates tray 110 with cover 160 removed and the interior of compartment 111 visible. Cover 160 may be removable from tray 110 to uncover compartment 111 and/or to allow a user access compartment 111, and/or any or all compartments in embodiments in which tray 110 includes more than one compartment 111, as discussed in more detail below.

Figure 9:
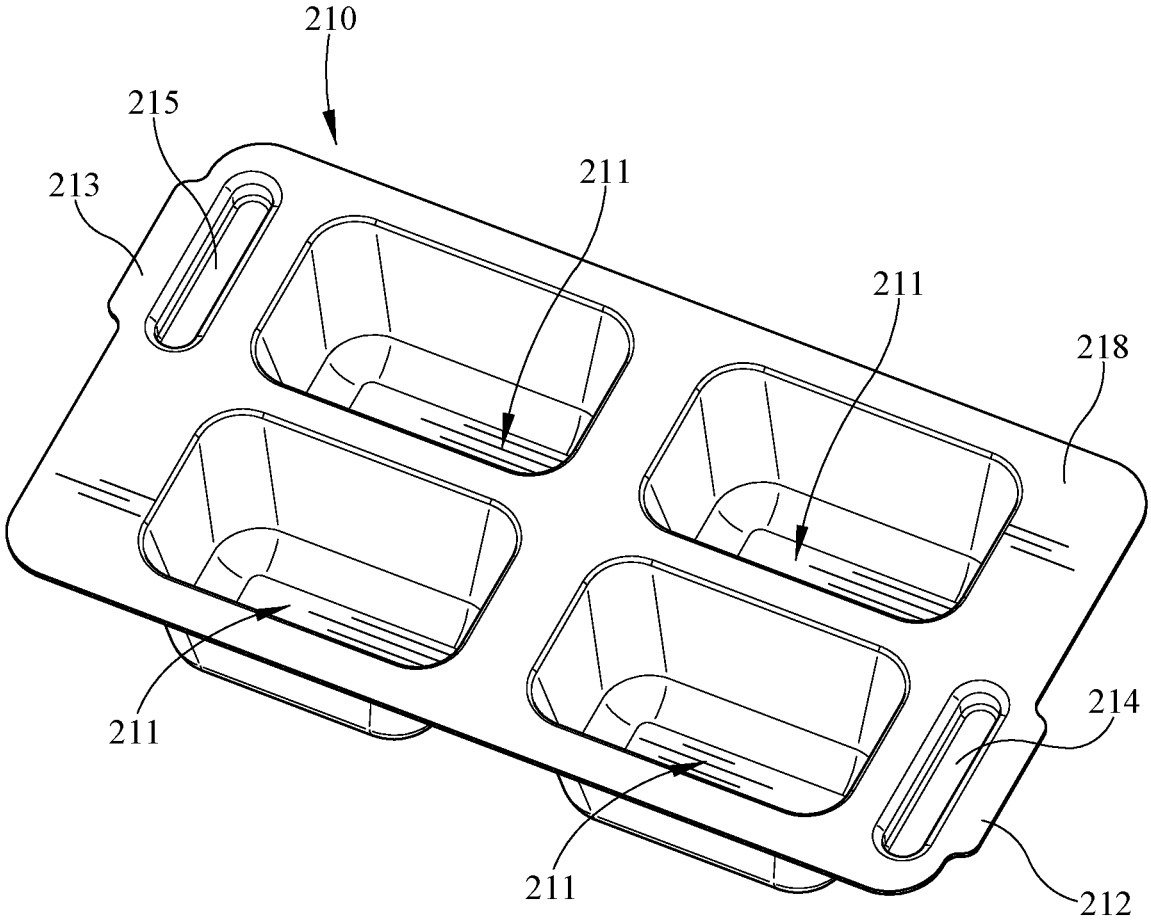
FIG. 9 illustrates a perspective view of an alternative embodiment of a tray.
Figure 10:
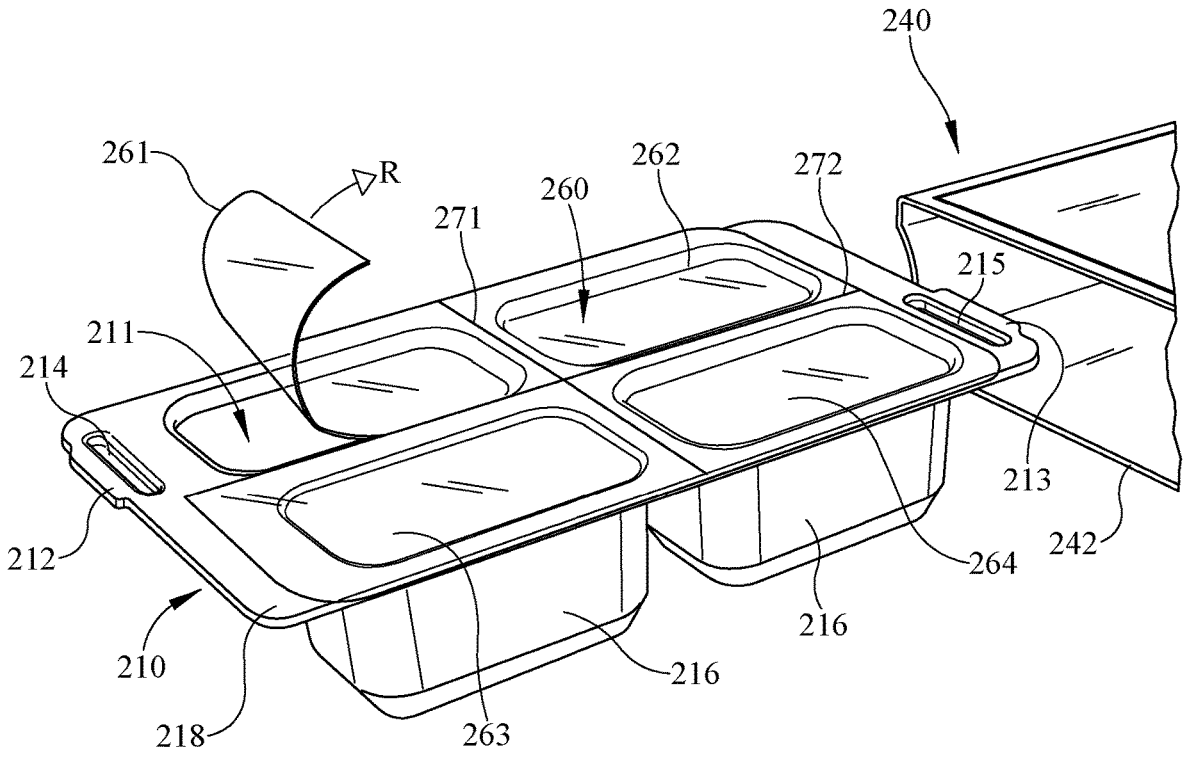
FIG. 10 illustrates a perspective view of a portion of a package that includes the tray of FIG. 9 with a cover partially removed to partially uncover a compartment of the tray.

A second embodiment of a tray 210 and a case 240 are illustrated in FIGS. 9 and 10. As shown, tray 210 may include four rectangularly shaped compartments 211 arranged in a two by two array, for example. A user may remove tray 210 from case 140, may remove (e.g., peel back) cover 260 from one or more of the compartments 211, and may access the contents therein. As shown in FIG. 10, for example, cover 260 may be partially pulled back to uncover some or all of a single compartment 211. Tray 210 may include a flange 218 located at or around an outer perimeter at a top surface opposite a floor 217 of tray 210. Tray 210 may include one or more compartment side walls 216, which may extend between floor 217 and flange 218 to at least partially form compartments 211.

In the embodiment shown in FIGS. 9 and 10, a first push tab 212 may be located at a first end of tray 210 and a second push tab 213 may be located at a second end of tray 210, with the first end disposed opposite the second end. As shown, in addition to be on opposite ends, first tab 212 and second tab 213 may be offset from center such that first tab 212 and second tab 213 are proximate opposite corners of tray 210. A first pocket 214 may be located adjacent first tab 212 and/or a second pocket 215 may be located adjacent second tab 213, such that tray 210 may enter into case 240 either first tab 212 first or second tab 213 first and engage a locking protrusion 275 (not shown) in substantially the same manner as described above with respect to pockets 114 and 115 and locking protrusion 175. If either or both pocket 214 or 215 is offset as shown in FIGS. 9 and 10, a corresponding slot 245 (not shown) similar to slot 145 described above may be offset such that pocket 214 or 215 align and cooperate with slot 245 to allow access to respective push tab 212 or 213, for example, substantially as described above to allow a user to unlock package 200. To facilitate engagement of case 240 and tray 210 in the closed and/or locked positions whether first pocket 214 or second pocket 215 engages the locking protrusion of case 240, or for any other reason, slot 245 may be offset in a first width direction a given distance, second pocket 215 may be offset in the first width direction about the same given distance, and first pocket 214 may be offset in a second width direction opposite the first width direction about the same given distance. As shown in FIG. 10, a first widthwise perforated line 271, discussed in more detail below, may extend in the first width direction and/or the second width direction.

As shown in FIG. 10, cover 260 may cover any or all of tray compartments 211. Cover 260 may include one or more frangible areas such as perforated lines 271, 272 that may separate and/or divide cover 260 into a plurality of panels each of which may cover a selected compartment or group of compartments, such as individual panels 261, 262, 263, and 264. Perforated lines 271, 272 may be configured to correspond to the arrangement of tray compartments 211. For example, as shown in FIG. 10, a lengthwise perforated line 272 may separate tray compartments located side by side, while widthwise perforated line 271 may separate tray compartments located end to end. If included, the frangible areas such as perforated lines 271, 272 may be provided to facilitate controlled breaking, tearing, and/or separating of cover 260 so that it may be selectively removed by a user (e.g., by hand) to uncover or partially uncover only as many compartments as the user desires. A user may grasp a portion of cover 260 and peel it back, for example with an input such as removal motion R, separating it along a perforated line 271 and/or 272 to uncover or partially uncover a compartment or group of compartments 211 so that the user may then access the contents of that compartment or group of compartments 211. Tray compartments 211 may be arranged in various configurations, such as the side by side and end to end configuration shown in FIG. 10. This configuration of compartments 211, with two side by side pairs, and each compartment 211 of each pair arranged end to end or serially, is merely one example a configuration that may be used. For example, panel 261 may be removed from tray 210 and/or compartment 211 by removal motion R to uncover the contents therein. If perforated lines or the like are included in cover 260, such as lengthwise perforated line 272 and/or widthwise perforated line 271, they may facilitate the clean break and removal of panel 261 from over a single compartment 211 without necessitating removal of cover 260 entirely or uncontrollably from tray 210 or other compartments 211. Other panels of cover 260 may be included and, if so, may be removed from a single compartment or group of compartments 211 as desired.

Figure 11A:
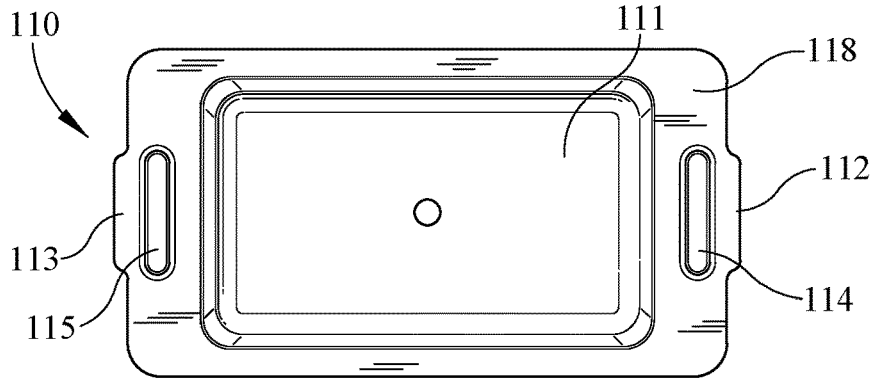
FIG. 11*a* illustrates a top view of the tray of FIG. 8.
Figure 11B:
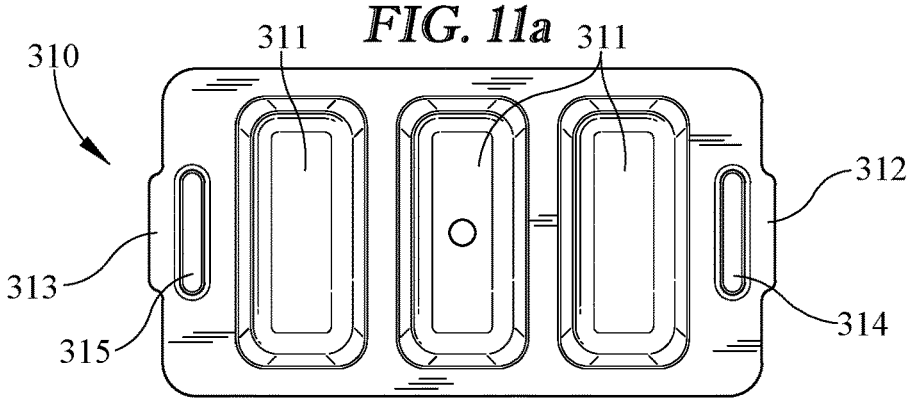
FIG. 11*b* illustrates a top view of a third embodiment of a tray.
Figure 11C:
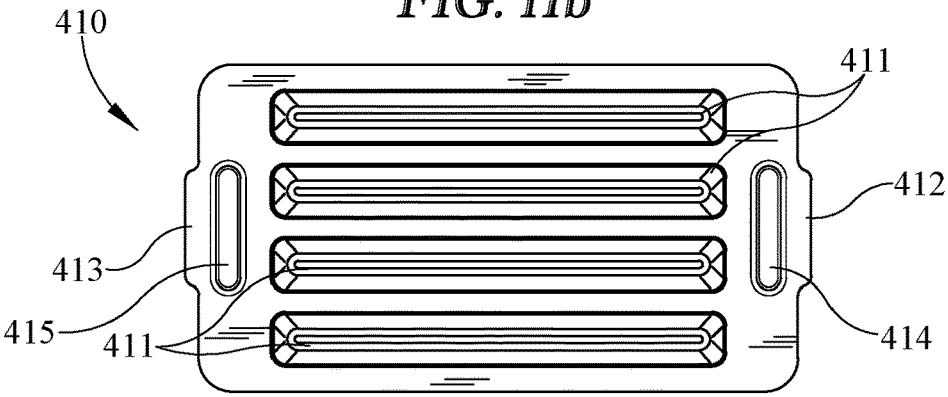
FIG. 11*c* illustrates another alternative embodiment of a tray.
Figure 11D:
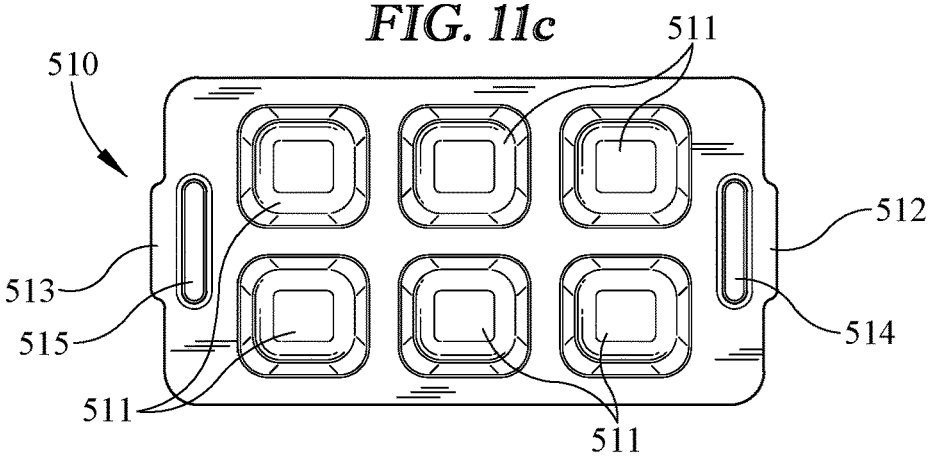
FIG. 11*d* illustrates yet another alternative embodiment of a tray.

A variety of alternate tray embodiments are shown in FIGS. 11*a*-11*d*. FIG. 11*a* illustrates tray 110 with a single product storage compartments 111 disposed between first end 112 and second end 113. FIG. 11*b* illustrates an embodiment of a tray 310 with three product storage compartments 311 between tray first end 312 and tray second end 313, with each compartment 311 arranged serially end to end between first end 312 and second end 313. In this embodiment, a first pocket 314 is located adjacent first end 312 and a second pocket 315 is located adjacent second end 313. FIG. 11*c* illustrates another embodiment of tray 410 having four product storage compartments 411 arranged in series in a direction transverse to a direction from tray first end 412 to tray second end 413. In this embodiment, a first pocket 414 is located adjacent first end 412 and a second pocket 415 is located adjacent second end 413. FIG. 11*d* illustrates an embodiment of a tray 510 having six product storage compartments 511, arranged in a pair of series of three compartments 511, with each series of three compartments arranged serially in a direction from first tray end 512 to second tray end 513, and with the pair of series of three side by side in a direction transverse to the direction from first tray end 512 to second tray end 513. In this embodiment, a first pocket 514 is located adjacent first end 512 and a second pocket 515 is located adjacent second end 513. It is understood that FIGS. 11*a*-11*d* are provided for illustrative purposes only, and virtually any number, size, shape, configuration, and/or orientation of product storage compartments may be included. Tray 310, 410, 510, and/or any other tray that may be provided may include a flange similar to flange 118, for example, such that a variety of trays such as tray 110, tray 310, tray 410, and tray 510 may be used interchangeably with case 140.

Figure 12:
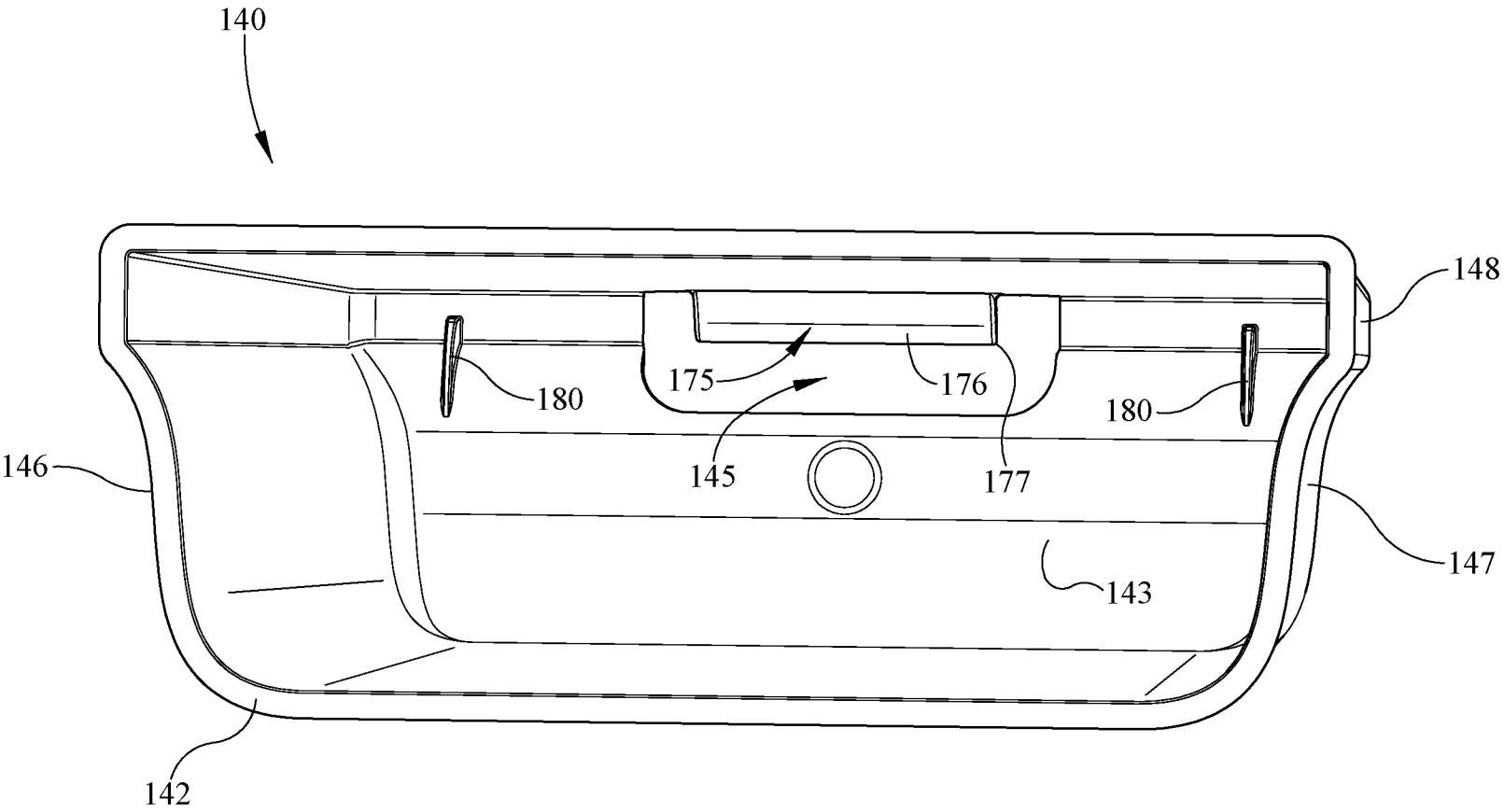
FIG. 12 illustrates a perspective view of an embodiment of a case showing interior features of the case.
Figure 13:
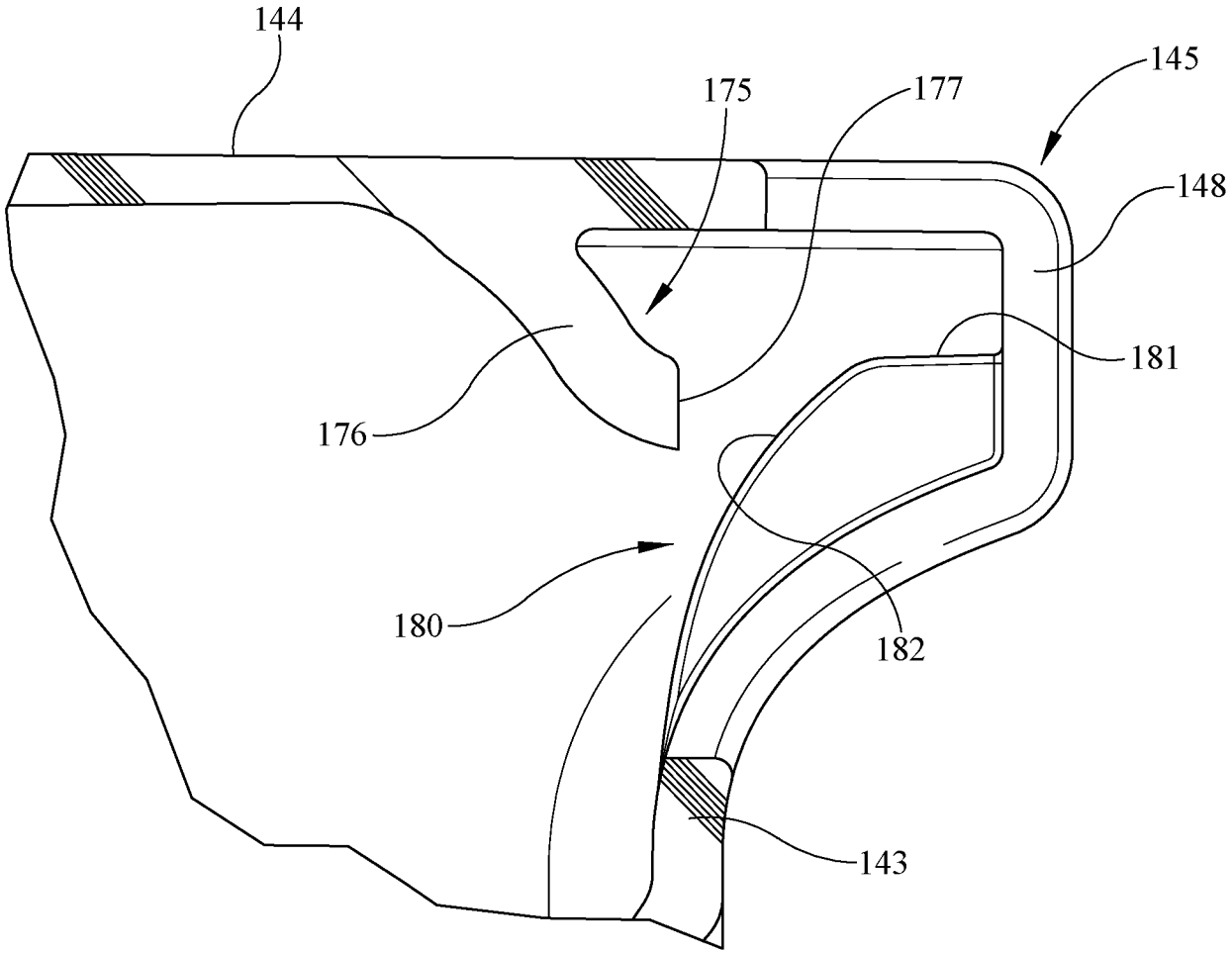
FIG. 13 illustrates a cross-section view of a portion of the case of FIG. 12 showing a locking protrusion and an inner rib in more detail.

Interior features of case 140 are shown in addition detail in FIGS. 12 and 13. Case 140 may include one or more support features such as interior ribs 180. Interior ribs 180 may be configured to support a portion of tray 110, such as flange 118 at or near first end or first push tab 112, for example, such that when subject to a user input such as push P, interior ribs 180 may add rigidity to tray 110 and/or flange 118 and/or make it more difficult and/or optimize the force of push P needed to unlock tray 110 relative to case 140. Interior ribs 180 may bias tray 110 or a portion thereof upwardly toward a locked position with case 140, which bias may be overcome to move tray 110 from the locked position to the unlocked position. In some embodiments, a pair of ribs 180 may be included, with one rib located on either side of slot 145 and/or locking protrusion 175. Support surfaces such as ribs 180 may be located about 2" apart from each other, or each about 1" from center of case 140. This exemplary location of ribs 180 may be suitable for child resistant locking, for example, for a polypropylene tray 110 with a thickness in the range of about 25 mil to about 60 mil, and/or about 40 mil. In some embodiments, shoulder 148 may provide a support surface on either or both sides of pocket 115. For example, in an embodiment having a pocket offset from center, as with tray 210 for example, shoulder 148 may provide one support surface while a rib on the opposite side of pocket 215 may provide a second support surface. In an embodiment with a relatively narrow tray 110 and/or case 140, and/or in an embodiment with a relatively stiff tray 110 and/or flange 118, shoulder 148 on either side of pocket 115 may provide sufficient support surface for biasing tray 110 toward the locked position in the absence of a user input for unlocking tray 110, such as push P. As shown in FIG. 12, shoulder 148 may be located farther outward from center than first side wall 146 and/or second side wall 147. Either or both of first side wall 146 and second side wall 147 may be angled or arced outwardly from bottom to top, for example, such that shoulder 148 may accommodate flange 118 of tray 110 and/or flange 218 of tray 210.

As tray 110 is inserted into case 140, for example from an open position to the closed position, tray 110 and/or flange 118 may ride up a side of rib 180 such as rib cam 182 to move tray 110, flange 118, and/or pocket 115 upwardly such that pocket 115 may be encouraged to engage locking protrusion 175 to provide the locked position discussed above. For example, in the locked position, tray 110 and/or flange 118 may rest on a relatively horizontal or flat rib upper edge 181. For example, in some embodiments, rib cam 182 may have a radius of about 0.3". In some embodiments, rib upper edge 181 may have a length in an axial or longitudinal direction in the range of about 0.02" to about 0.2", and/or about 0.06". Tray 110 and case 140 may be configured such that there is a relatively small distance that tray 110 can move relative to case 140 in the axial or longitudinal direction while in the locked position such that the amount of overlap between flange 118 and/or second outwardly extending portion 113*b* with rib upper edge 181 is in the range of about 0.002" and about 0.2", in the range of about 0.01" and about 0.1", and/or in the range of about 0.01" and 0.06".

Locking protrusion 175 and/or locking protrusion body 176 may be sized, shaped, and/or configured to facilitate insertion of tray 110 into case 140 and/or to provide the locked position, as shown in FIG. 13. For example, locking protrusion 175 may extend toward locking protrusion tip 177 downwardly from case top 144 and/or backward or toward case second end 143. Locking protrusion body 176 may be angled or arced relative to a vertical direction such that it will gradually bias tray 110, flange 118, and/or second outwardly extending portion 113*b* downwardly until second outwardly extending portion 113*b* of tray 110 passes locking protrusion tip 177 and locking protrusion 175 engages pocket 115 to provide the locked position discussed above. Locking protrusion tip 177 may be configured to have a relatively vertical surface such that it provides the mechanical stop with pocket 115 and/or outward side wall 115*b* discussed above. A portion of tray 110 adjacent tray second end 113 and/or pocket 115 may deform when tray 110 is moved to the unlocked position relative to case 140 as a user pushes down on the portion of tray 110 while one or more ribs 180 prevent downward motion of other areas of tray 110 or flange 118. The deformed portion of tray 110, second end 113, and/or flange 118 may spring back to its original shape and/or back to the locked position in the absence of user push force P or the like. The deformed portion of tray 110, second end 113, and/or flange 118 may be located between the support surfaces of case 140 preventing or resisting downward motion of tray 110, second end 113, and/or flange 118, such as ribs 180 and/or shoulder 148, for example, and may be deformed when a user input or actuation such as push force P or the like is applied.

It is understood that package 100, tray 110, case 140, and/or cover 160, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that package 100, tray 110, case 140, and/or cover 160, and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of package 100, tray 110, case 140, and/or cover 160, and/or any component thereof.

It is further understood that any of a variety of processes or combination thereof may be used to form package 100, tray 110, case 140, and/or cover 160, and/or any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, package 100, tray 110, case 140, and/or cover 160, and/or any component thereof may be formed substantially of injection molded and/or thermoformed suitable plastics material, although other materials and forming processes may be used instead of or in addition to injection molding and thermoforming, respectively. In some embodiments, tray 110 may be thermoformed and case 140 may be injection molded, for example. Various materials and/or processes may be used to form package 100, tray 110, case 140, and/or cover 160, and/or any component thereof, as will be understood by one of ordinary skill in the art. In some embodiments, tray 110, case 140, and/or cover 160, and/or any component thereof, may be substantially a one-piece design and/or substantially formed as an integral or unitary structure.

It is understood that, while some directional terms are used herein, such as top, bottom, upper, lower, inward, outward, upward, downward, etc., these terms are not intended to be limiting but rather to relate to one or more exemplary orientations, positions, and/or configurations of package 100, tray 110, case 140, and/or cover 160, and/or any component thereof. It is understood that package 100, tray 110, case 140, and/or cover 160, and/or any component of package 100, may be oriented differently than shown in the various figures.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A child resistant package, comprising:

a case and a tray, wherein the tray is selectively insertable into the case to provide a closed position and removable from the case to provide an open position;

the tray having at least one product storage compartment, a first end, and a second end located opposite the first end, wherein the product storage compartment is disposed between the first end and the second end;

a pocket adjacent the second end of the tray;

the case having a first end with an opening configured to allow insertion and removal of the tray within the case, and the case having a second end opposite the case first end, wherein the case second end includes a slot for receiving the second end of the tray;

a locking protrusion on the case configured to engage the pocket of the tray;

wherein the tray second end is movable by a user input between a locked position and an unlocked position, wherein the locking protrusion of the case and the pocket of the tray cooperate to form a mechanical stop inhibiting moving the tray relative to the case from the closed position to the open position when the tray is in the locked position;

wherein the tray is movable in an axial direction between the open position and the closed position; and wherein the tray second end is movable from the locked position to the unlocked position by a user input causing movement of the pocket relative to the locking protrusion in a direction transverse to the axial direction to remove the mechanical stop and allow removal of the tray from the case.

2. The package of claim 1, wherein the tray includes at least a second product storage compartment.

3. The package of claim 2, wherein the tray includes a plurality of compartments arranged in series in a direction from the first tray end to the second tray end.

4. The package of claim 2, wherein the tray includes a plurality of compartments arranged in series in a direction transverse to a direction from the first tray end to the second tray end.

5. The package of claim 1, wherein the pocket of the tray is a first pocket located on a top surface of the tray second end.

6. The package of claim 5, wherein the tray includes a second pocket located on a top surface of the tray first end.

7. The package of claim 6, wherein the first pocket and the second pocket are located proximate diagonally opposite corners of the tray, and the tray and case are configured such that either the first pocket or the second pocket are engageable with the locking protrusion of the case and either end of the tray may be inserted into the case first to provide the closed position and the locked position.

8. A child resistant package, comprising:

a case and a tray, wherein the tray is selectively insertable into the case to provide a closed position and removable from the case to provide an open position;

the tray having at least one product storage compartment, a first end, and a second end located opposite the first end, wherein the product storage compartment is disposed between the first end and the second end;

the case having a first end with an opening configured to allow insertion and removal of the tray within the case, and the case having a second end opposite the case first end;

wherein the second end of the tray is configured to cooperate with the case to form a locked position;

wherein the tray second end is movable by a user input between the locked position and an unlocked position;

wherein the tray is movable in an axial direction relative to the case between the open position and the closed position;

wherein a mechanical stop prevents the tray from moving from the closed position to the open position when the tray is in the locked position and wherein the tray is movable to the unlocked position to remove the mechanical stop and allow movement of the tray from the closed position to the open position; and an interior support surface located in the case and configured to prevent downward motion of a portion of the tray when the tray is moved from the locked position to the unlocked position, wherein the interior support surface biases the portion of the tray toward the locked position in the absence of the user input moving the tray from the locked position to the unlocked position.

9. The package of claim 8, wherein the interior support surface is a first rib.

10. The package of claim 8, wherein the interior support surface is a shoulder.

11. The package of 9, further comprising a second rib, wherein the first rib and the second rib are disposed on opposite sides of the second end of the tray when the tray is in the closed position and the locked position.

12. The package of claim 9, wherein the first rib includes a cam biasing the tray upwardly toward a top of the case when the tray is moved to the closed position.

13. The package of claim 9, wherein first rib includes a flat upper surface configured to support the tray when in the closed position.

14. A child resistant package, comprising:

a case and a tray, wherein the tray is selectively insertable into the case to provide a closed position and removable from the case to provide an open position;

the tray having at least one product storage compartment, a first end, and a second end located opposite the first end, wherein the product storage compartment is disposed between the first end and the second end;

a pocket adjacent the second end of the tray;

the case having a first end with an opening configured to allow insertion and removal of the tray within the case, and the case having a second end opposite the case first end, wherein the case second end includes a slot for receiving the second end of the tray;

a locking protrusion on the case configured to engage the pocket of the tray;

wherein the tray second end is movable by a user input between a locked position and an unlocked position, wherein the locking protrusion of the case and the pocket of the tray cooperate to form a mechanical stop inhibiting moving the tray relative to the case from the closed position to the open position when the tray is in the locked position;

wherein the tray is movable in an axial direction between the open position and the closed position;

wherein the tray second end is movable from the locked position to the unlocked position by a user input causing movement of the pocket relative to the locking protrusion in a direction transverse to the axial direction to remove the mechanical stop and allow removal of the tray from the case; and an interior support surface located in the case and configured to prevent downward motion of a portion of the tray when the tray is moved from the locked position to the unlocked position, wherein the interior support surface biases the portion of the tray toward the locked position in the absence of the user input moving the tray from the locked position to the unlocked position.

15. The package of claim 14, wherein the tray is made of polypropylene.

16. The package of claim 15, wherein the tray has a flange having a thickness of about 20 mil to about 60 mil.

17. The package of claim 16, wherein the tray has a flange having a thickness of about 40 mil.

18. The package of claim 16, wherein the interior support surface is a rib located about 1" off center relative to a center of the pocket of the tray.

19. The package of claim 14, further comprising a shoulder in the case adjacent a top wall of the case, wherein the shoulder is wider than a portion of the case side wall adjacent a bottom of the case.

20. The package of claim 19, wherein the shoulder forms the interior support surface.

* * * * *